US005245777A

United States Patent [19]

Neuman et al.

[11] Patent Number: 5,245,777

[45] Date of Patent: Sep. 21, 1993

[54] SELF CONTAINED SWAB GUN

[75] Inventors: John A. Neuman, Sparta; Stephen G. Floroff, Hopatcong, both of N.J.

[73] Assignee: The United States of America as represented by the Secretary of the Army, Washington, D.C.

[21] Appl. No.: 936,156

[22] Filed: Aug. 27, 1992

[51] Int. Cl.[5] ..... F41A 29/02

[52] U.S. Cl. ..... 42/95; 401/9; 401/176; 401/188 R; 401/190

[58] Field of Search ..... 42/95; 401/9, 176, 186, 401/188, 190

[56] References Cited

U.S. PATENT DOCUMENTS

| | | | |
|---|---|---|---|
| 464,843 | 12/1891 | Bagger | 401/9 |
| 1,067,780 | 7/1913 | Brink | 401/188 |
| 1,522,837 | 1/1925 | Rebar | 412/95 |
| 3,814,525 | 6/1974 | Spencer | 401/190 |
| 4,858,360 | 8/1989 | Hardin | 42/95 |
| 5,095,644 | 3/1992 | McCoy | 42/95 |

*Primary Examiner*—Harold J. Tudor

*Attorney, Agent, or Firm*—Anthony T. Lane; Edward Goldberg; Michael C. Sachs

[57] ABSTRACT

A device for swabbing artillery cannon chambers, obturators and the like. The device includes a cylinder for holding a fluid such as water and also has a gas pressure source such as a hand operated air pump for placing the fluid in the cylinder under a positive pressure. The gas pressure or air pressure is adjustably controllable. Also included is a tube extension in communication with the cylinder to receive the fluid under slight pressure. The tube extension includes a valve for controllably introducing water under pressure into the tube extension. A sponge is mounted on the other end of the tube so as to absorb water through the tube to wet the sponge. The device is controlled with a handle on the cylinder to permit insertion and removal of the sponge into a cannon chamber while the sponge contains some of the fluid. The hand operable pump is axially centered about the axis of the cylinder for adding air pressure in the cylinder. In a preferred embodiment, the handle is toroid shaped and the hand operable pump is positioned inside the toroid shaped handle to permit pumping while holding toroid shaped grip. The sponge is preferably removably mounted for replacement as needed because of wear or damage.

2 Claims, 1 Drawing Sheet

SELF CONTAINED SWAB GUN

The invention described herein may be made, used, or licensed by or for the Government for Governmental purposes without the payment to us of any royalties thereon or therefor.

FIELD OF THE INVENTION

The present invention relates to a device for swabbing an artillery cannon and more particularly to a device for efficiently and safely cleaning the chamber and obturator of an artillery cannon between firings.

BACKGROUND OF THE INVENTION

Traditionally, the chamber and obturator of an artillery cannon is wiped down with a water soaked sponge after each firing of the gun. This procedure has been found to be necessary in order to remove all of the remaining flaming debris which may be present in the tube. Also, this procedure is employed to reduce or eliminate build-up of combustion by-products on the chamber walls and obturator.

After each firing, the cannon is cleaned with a sponge which has been attached to a long, slender rod. The rod is, in turn, alternately pushed into the chamber and retracted and the obturator is cleaned with a circular motion of the sponge, usually as a routine duty of one of the gun crew. Since the chamber of the cannon can become quite hot there is potential for flaming debris in the tube, the sponge must be wet during all cleaning operations.

In traditional circumstances, the sponge is wetted by simply immersing it into a bucket of water. However, placement of the rod and sponge assembly into the water bucket creates an unstable or "tip-over" condition, since the length of the rod is considerably greater than the height of the bucket. Additionally, in the case of a self-propelled howitzer, excess water in the sponge can drip on the vehicle floor as the sponge is moved to the cannon, and drip from the chamber and obturator during the swabbing process. This can cause a slipping hazard for the crew.

Under the best of circumstances, the spilling of water may necessitate cessation of firing while the bucket is re-filled and in the case of a self-propelled howitzer, a wet floor can cause personnel to slip and fall inside the vehicle. In actual field use, particularly during an unscheduled firing mission, water may not be readily available at the firing site. Either choice of halting firing to fetch water or firing without cleaning is an unacceptable choice. For example, flaming debris left in the cannon has the very real potential to prematurely ignite the next propelling charge as it is installed into the chamber. Also, combustion by-product build-up, if not cleaned after firing, can become unacceptably significant and does quickly cause clean-up problems after a fire mission is completed.

Accordingly, it is an object of the present invention to provide a self-contained, safe and reliable mechanism for swabbing artillery cannons in the field.

Another object is to provide a device which can be used repeatedly without having to procure water after each use or even after a small number of uses.

Yet another object of this invention is to provide a device for swabbing cannons without concern for inadvertent spilling of water, even under adverse circumstances of use.

Other objects will appear hereinafter.

BRIEF DESCRIPTION OF THE DRAWINGS

For a more complete understanding of the invention, reference is hereby made to the drawings, in which.

SUMMARY OF THE INVENTION

It has now been discovered that the above and other objects of the present invention may be accomplished in the following manner. Specifically, the invention comprises a device for swabbing artillery cannon chambers, obturators and the like.

The device of this invention includes a cylinder for holding water and also has a gas pressure source such as a hand operated air pump for placing the fluid in the cylinder under a positive pressure. The gas pressure or air pressure is obtained by a hand operated air pump centered axially behind the cylinder. A swabbing handle is formed from a toroid shape attached to the cylinder by rods. After pressurizing the fluid, the hand pump is locked into a fully compressed position so as not to create interference while holding the handle.

Also includes in the device of this invention is a tube extension which encases a plastic tube connected the cylinder to the sponge head via a valve for controllably introducing water under pressure into the sponge head. The valve preferably includes a valve control lever extending outward from the cylinder axis in easy access to the hands of the user.

A sponge is removably mounted on a sponge head at the other end of the tube so as to absorb water through the plastic tube to wet the sponge. The device is controlled by holding the handle and tube extension which functions as a front or insertion end handle to permit insertion and removal of the sponge into a cannon chamber while the sponge contains some of the fluid. In a preferred embodiment, the sponge is preferably removably mounted for replacement as needed because of wear or damage.

DETAILED DESCRIPTION OF THE PREFERRED EMBODIMENT

Figure 1:
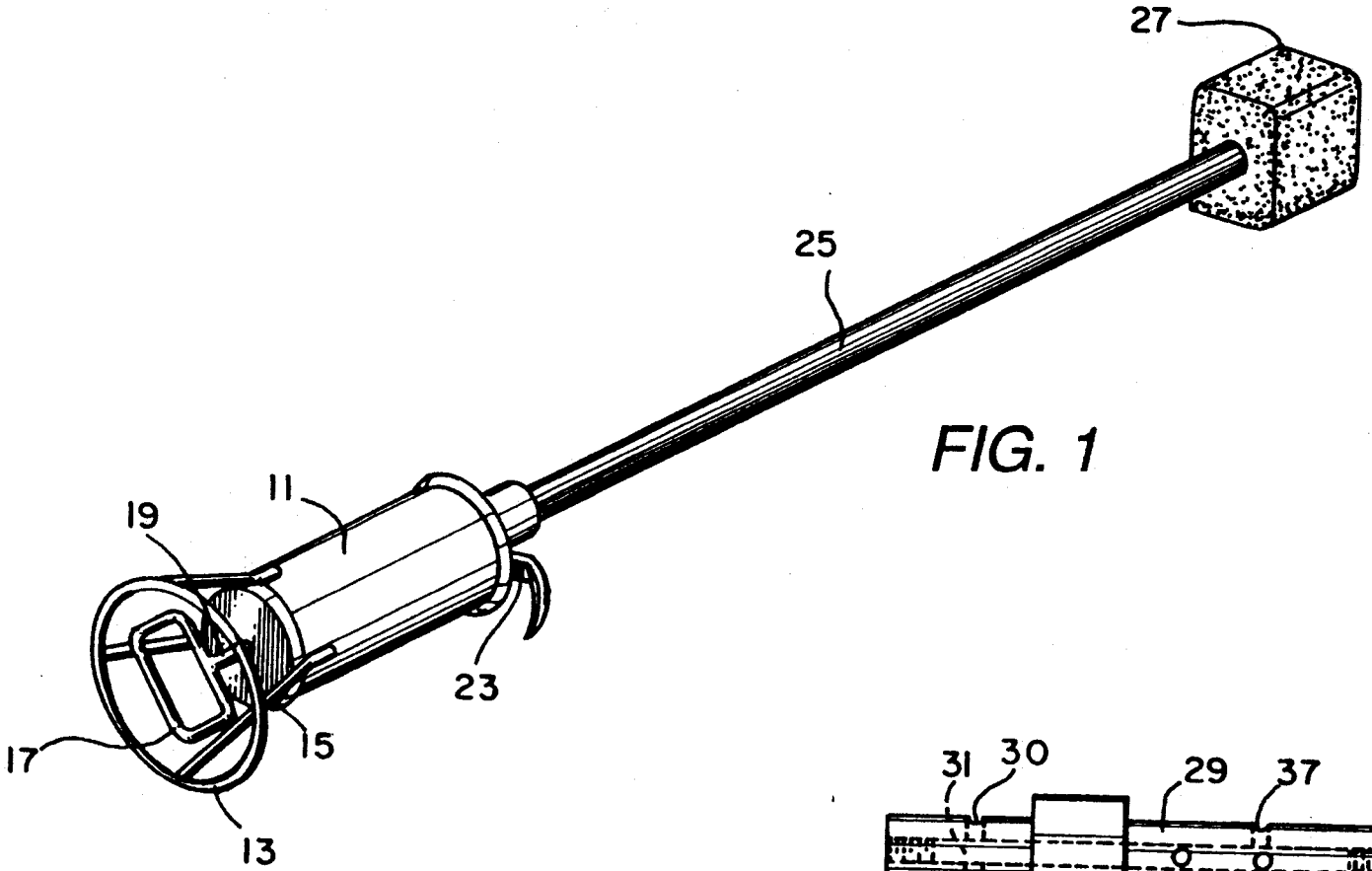
FIG. 1 is a perspective view illustrating the device of this invention.

As shown in FIG. 1, the device of this invention includes a hollow right circular cylinder 11 which is filled with a fluid such as water to a fill mark, leaving a portion unfilled for air pressure to be added. Positioned inside the handle 13 and handle supports 15 is a hand operated air pump 17 which is removable for placing the fluid in cylinder 11 under a positive pressure. The air pressure is generated by the hand operated air pump handle 17 via shaft 19 into the cylinder 11. Pump 17 and shaft 19 are axially centered in handle 13, as handle 13 has a toroid shape. This alignment permits axial movement of the air pump handle 17 with one hand to build up pressure while holding handle 13 with the other hand.

Tube extension 25 is in communication with cylinder 11 to receive water under pressure from cylinder 11. Tube extension 25 includes valve 23 (which valve device is generally known but not shown directly in the Figure except for its position), which is a spring loaded poppet valve placed in the path of fluid flow for controllably introducing water under pressure into the tube 25. Valve 23 includes a valve control lever extending outward from cylinder 11 to provide easy access to the user.

Figure 2:
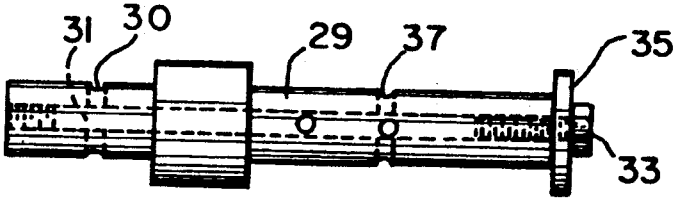
FIG. 2 is an enlarged, partially sectioned view of the attachment device for removably attaching a sponge to the end of the device.

Sponge 27 is removably mounted on the other end of tube 25 and is positioned to absorb water through tube 25 to wet sponge 27. Shown in FIG. 2 are the details of the sponge mount. Sponge body mount 29 fits into tube 25 and is held to tube 25 with screws tapped into tube 25 which bottom in recesses 30.

As shown, body mount 29 is hollow, as is tube 25, and fluid flows into body mount 29 via channel 31. Fluid can only flow as far as the end of channel 31 since the body mount 29 terminates in a bolt 33. Bolt 33 and washer 35 are removable so that a sponge can be fit on body mount 29 and held in place by washer 35 until it is time to replace the sponge. Fluid flows out of radial ports 37 into the body of the sponge, keeping the sponge wet for use in the cannon. The volume of water in sponge 27 is controlled by valve control lever.

The device is controlled by holding handle 13 and tube 25 to permit insertion and removal of sponge 27 into a cannon while the sponge contains some of the water. The hand operable pump 17 is pumped to add air pressure in cylinder 11 during non-swabbing periods.

In order to demonstrate the efficacy of the present invention, a prototype device was constructed according to the principles of this invention and as shown in the Figures. The prototype device was then tested in actual use with an artillery cannon during an actual ire mission and was successful. The sponge was wetted as needed and no hazardous conditions were encountered.

While particular embodiments of the present invention have been illustrated and described herein, it is not intended that these illustrations and descriptions limit the invention. Changes and modifications may be made herein without departing from the scope and spirit of the following claims.

We claim:

1. A device for swabbing artillery cannon chambers, including chambers having obturators, said device comprising:

cylinder means holding a fluid and having an axis, said cylinder means including hand operable air pressure means for placing said fluid in said cylinder means under a positive pressure, said air pressure means being adjustably controllable;

tube extension means in communication with said cylinder means to receive said fluid under pressure along the axis of said cylinder means at one end of said tube extension means, said tube extension means including valve means for controllably introducing said fluid under pressure from said cylinder means to said tube extension means for transfer of said fluid through said tube extension means;

sponge means removably mounted on the other end of said tube extension means for receiving said fluid through said tube extension means and wetting said sponge means for use of said sponge means as a swab; and handle means rigidly attached on an end of said cylinder means which is opposite to the end where said tube extension means communicates with said cylinder means, to permit insertion and removal of said sponge into a cannon while said sponge contains some of said fluid, wherein said handle means includes a toroid shaped grip means, and said hand operable pump means is positioned within said toroid shaped grip to permit pumping with said pump means while still grasping on the toroid shaped grip handle means.

2. The device of claim 1 wherein said fluid is water.

* * * * *